US006664523B1

(12) United States Patent
Kim et al.

(10) Patent No.: US 6,664,523 B1
(45) Date of Patent: Dec. 16, 2003

(54) MICROWAVE OVEN CAPABLE OF PREVENTING OVERCURRENT OF A MICROSWITCH FOR CONTROLLING A DC POWER SOURCE

(75) Inventors: Chul Kim, Anyang (KR); Yong-woon Han, Kunpo (KR); Seong-deog Jang, Suwon (KR); Han-jun Sung, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/831,314

(22) PCT Filed: Jan. 4, 1999

(86) PCT No.: PCT/KR99/00001

§ 371 (c)(1),
(2), (4) Date: May 8, 2001

(87) PCT Pub. No.: WO00/28789

PCT Pub. Date: May 18, 2000

(30) Foreign Application Priority Data

Nov. 11, 1998 (KR) ..... 98/48170

(51) Int. Cl.[7] ..... H05B 6/68
(52) U.S. Cl. ..... 219/722; 219/702
(58) Field of Search ..... 219/722, 702, 219/715, 716, 717, 718, 723, 739; 363/15, 34

(56) References Cited

U.S. PATENT DOCUMENTS

| | | | | |
|---|---|---|---|---|
| 3,700,846 A | * | 10/1972 | Ishikawa et al. | 219/723 |
| 3,967,088 A | * | 6/1976 | Horiuchi | 219/723 |
| RE30,248 E | * | 4/1980 | Fritts | 219/722 |
| 4,232,210 A | | 11/1980 | Oida | |
| 4,785,152 A | | 11/1988 | Hirata | |
| 4,904,837 A | * | 2/1990 | Low et al. | 219/717 |
| 4,920,246 A | * | 4/1990 | Aoki | 219/716 |
| 5,362,946 A | | 11/1994 | Matsushita | |
| 5,777,301 A | | 7/1998 | Kim | |

FOREIGN PATENT DOCUMENTS

| | | |
|---|---|---|
| DE | 3130769 A1 | 4/1982 |
| DE | 4143366 C2 | 6/1995 |
| EP | 0052871 | 6/1982 |

* cited by examiner

*Primary Examiner*—Quang T. Van
(74) *Attorney, Agent, or Firm*—Robert E. Bushnell, Esq.

(57) ABSTRACT

A microwave oven has a case forming a cooking chamber, a door for opening/closing said chamber, a high voltage transformer for generating a high voltage, and a magnetron for generating microwaves driven by the high voltage outputted from the high voltage transformer. The microwave oven further includes a microswitch serving as a detector for detecting opening/closing of the cooking chamber; a control device for outputting a driving signal corresponding to the detected opening/closing of the chamber, and an opening/closing device for controlling a power source supplying power to the high voltage transformer according to reception of the driving signal.

14 Claims, 8 Drawing Sheets

MICROWAVE OVEN CAPABLE OF PREVENTING OVERCURRENT OF A MICROSWITCH FOR CONTROLLING A DC POWER SOURCE

TECHNICAL FIELD

The present invention relates to a microwave oven, and more particularly to a microwave oven capable of preventing overcurrent of a microswitch for controlling a DC power source, which is capable of being prevented from holding the previous status of contacts in a microswitch caused by the large amounts of current which are remaining when usig direct current.

BACKGROUND ART

FIG. 1 shows a microwave oven for heating/cooking food using microwaves. The microwave oven contains a case 20 for forming a cooking chamber 22, a door 21 for opening/closing the cooking chamber 22, a tray 24 being installed in the cooking chamber 22, and a panel 25 for controlling operations of the microwave oven.

FIG. 2 is a partial cutaway view of FIG. 1. A pair of latch hooks 28*a*, 28*b* are installed in the door 21, and catch openings 27*a*, 27*b* are formed corresponding to each latch hook 28*a*, 28*b* at a front plate 26 of the case 20. If the door 21 is pushed shut, the latch hooks 28*a*, 28*b* will engage the catch openings 27*a*, 27*b* to hold the door 21 shut.

At the back side of the panel 25 is provided a device chamber (not shown). In the device chamber are installed a magnetron for generating microwaves and a high voltage transformer HVT for generating a high voltage supplied to the magnetron, and so on. In supplying an AC power to the high voltage transformer HVT, this high voltage transformer HVT generates a predetermined high voltage to drive the magnetron. Then, the magnetron radiates microwaves of about 2,450 MHz frequency to heat/cook food.

As shown in FIG. 2, microswitches MS1, MS2, MS3 are installed at the back side of the front plate 26 of the case 20. FIGS. 3*a*, and 3*b* are schematic diagrams and symbols of each microswitch MS1, MS2, MS3, respectively. The microswitches MS1, MS2, MS3 have a slight interval at the contacts, and a mechanism of a snap action. The microswitches MS1, MS2, MS3 have a contact mechanism to open/close by the determined operation and force in a sealing case, and is a small switch for arranging a pushing mechanism of the actuator switch located on the outside of the case. That is, the microswitch is one of the contact type detectors, which detects something contacted according to releasing the inside contacts when something 6 closes to a push button 1, and begins to push the push button 1, and applies more than a predetermined force F to the push button 1. In FIG. 3, the reference numeral 2 is a movable spring, and the reference numeral 3 is a movable contact. The reference numeral 4 is a fixed contact b, and the reference numeral 5 is a fixed contact a. COM, NO, and NC are a common terminal, a normally open terminal, and a normally closed terminal, respectively. In FIG. 3*b*, the contact a 7 is a point of contact which conducts first when the microswitch is operated, and which connects the common terminal COM into the normally open terminal NO. The contact b 7 is a point of contact which conducts when the microswitch is not operated, and which connects the common terminal COM into the normally close terminal NC.

The microswitches MS1, MS2, MS3 have each operating button 31, 32, 33, respectively. At the back side of the front plate 26 are installed a pair of movable members 29*a*, 29*b* to adjoin the catch openings 27*a*, 27*b*. Then, the movable members 29*a*, 29*b* are fixed for pivoting by each pin 23*a*, 23*b*, and are fixed elastically by each spring 41*a*, 41*b*.

In FIG. 2, if the door 21 is pushed close, the microswitches MS1, MS2, MS3 are operated by the latch hooks 28*a*, 28*b* which are inserted in the catch openings 27*a*, 27*b*. That is, when the movable members 29*a*, 29*b* are pushed by each latch hook 28*a*, 28*b*, the movable members 29*a*, 29*b* are rotated against the elasticity of the springs 41*a*, 41*b*. Therefore, the operating button 31 is pushed by the upper movable members 29*a*, and the operating buttons 32, 33 are pushed by the lower movable members 29*b*, respectively.

Meanwhile, since the conventional microwave oven has been made to be operated using the AC common power source of 110V/220V for supplying high alternating current, we cannot use the microwave oven in a place where alternating current is not available.

To overcome the above described problem, an AC/DC type microwave oven has been developed, and has been comprised as shown in FIG. 4. In FIG. 4, An AC/DC type microwave oven comprises an AC driving load 30, a DC driving load and DC/AC converting part 40, and a microwave oscillator 50. The AC driving load 30 is driven by an AC input power. The DC driving load and DC/AC converting part 40 includes the DC driving load being driven by a DC input power, and the DC/AC converter converting the DC input power into an AC power. The microwave oscillator 50 is supplied by only one of the AC input power or the DC/AC power converted by a DC/AC converter, and generates microwaves.

The AC driving load 30 is driven by alternating current, which includes a lamp and a fan motor, etc., which are connected to the AC power source. A power switch (not shown) to determine the supplying status of AC is connected to the AC power source. The DC driving load being driven by direct current, which includes a lamp and a fan motor, etc., which are connected to the DC power source. A power switch (not shown) to determine the supplying status of DC is connected to the DC power source. The direct current forms a differentiated DC circuit net discriminated as an AC circuit net. Then, direct current is connected to the input side of the DC/AC converting part 40 which supplies alternating current. The microwave oscillating part 50 includes a high voltage transformer HVT which receives the AC power, a high voltage condenser HVC, a high voltage diode HVD, and a magnetron MGT. The operation of the microwave oscillating part 50 is described the same way as shown in FIG. 1.

Therefore, according as the AC power source supplies alternating current to the AC driving load 30, and the DC power source supplies direct current to the DC driving load and DC/AC converting part 40, respectively, the conventional AC/DC type microwave oven is operated.

In the above-described AC/DC type microwave oven, the DC driving load and DC/AC converting part 40 is designed for the user to use the AC/DC type microwave oven out-of-doors, using the power source of an automobile battery. Generally, however, the common AC power source supplies small amounts of current within 15A, but the battery of the automobile using DC supplies large amounts of current from 50A to 70A.

If the microwave oven is operated by using the automobile battery, the microswitches MS1, MS2 have the possibility of a faulty operation.

That is, in case the large amounts of current is supplied through the microswitches MS1, MS2, the contact of the microswitches MS1, MS2 can remain in there contacting status. When the user pulls the door 21 so that the cooking chamber is open, the operating buttons 31, 32 of the microswitches MS1, MS2 can remain in their depressed status. According as the primary switch PD and secondary switch SD of the DC driving load and DC/AC converting part 40 are held in their closed status, and then current is supplied to the DC driving load and DC/AC converting part 40, so the AC/DC type microwave oven has the problem of encountering a malfunction.

DISCLOSURE OF INVENTION

The present invention has been made to overcome the problems with microwave ovens described in the foregoing paragraphs, and accordingly it is the first objective of the present invention to provide a microwave oven capable of preventing overcurrent of a microswitch for controlling a DC power source.

It is the second objective of the present invention to provide a microwave oven for heating/cooking food safely by preventing overcurrent of a microswitch for controlling a DC power source.

To achieve the above objectives, the present invention provides a microwave oven capable of preventing overcurrent of a microswitch for controlling a DC power source. In a microwave oven having a case forming a cooking chamber, a door for opening/closing the chamber, a high voltage transformer for generating a high voltage, and a magnetron for generating microwaves driven by the high voltage being outputted from the high voltage transformer, a microwave oven comprising: means for detecting opening/closing of the door; means for controlling for outputting a driving signal corresponding to the detected result; and means for opening/closing for controlling a power source supplied to the high voltage transformer according to receiving the driving signal.

The means for detecting is a microswitch which is a detector for detecting the openinig/closing of the door.

The means for opening/closing is an electromagnetic relay for controlling an opening/closing of an input power source to open/close a contact according to the driving signal, wherein the relay is an electromagnetic relay for controlling a supply of large amounts of current from 50A to 70A.

To achieve the above objectives, the present invention provides an interlock device of a microwave oven. In a microwave oven having a case forming a cooking chamber, a door for opening/closing the chamber, a high voltage transformer for generating a high voltage, and a magnetron for generating microwaves driven by the high voltage being outputted from the high voltage transformer, an interlocking device of a microwave oven comprising: microswitches for detecting opening/closing of the door; microcomputer for outputting a driving signal corresponding to the detected result; and a relay for opening/closing for controlling a power source supplied to the high voltage transformer according to receiving the driving signal.

The relay is an electromagnetic relay for controlling a supply of large amounts of current from 50A to 70A.

To achieve the above objectives, the present invention provides a microwave oven capable of preventing overcurrent of a microswitch for controlling a DC power source. In a microwave oven using microwaves, the microwave oven comprising: a DC circuit part for converting direct current supplied by a DC input power source into alternating current, and for supplying the converted alternating current; an opening/closing means for connecting between the DC input power source and the DC circuit part; a current dividing means being connected to the means for opening/closing, and for dividing a part of current supplied by the means for opening/closing when the means for opening/closing is switched on; and a microwave oscillating means for being driven by an output voltage of the high voltage transformer, and for generating microwaves.

The current dividing means is a relay connected to the opening/closing means in parallel. The present invention further comprises resistors for being connected to the opening/closing means and/or the relay current dividing means in series, respectively, and for regulating each rate of current through the opening/closing means and the relay, respectively.

To achieve the above objectives, the present invention provides a device for preventing overcurrent of a microswitch comprising: a microswitch for opening/closing the connection between DC input power source and a DC circuit part being supplied direct current; and a current dividing means being connected to the microswitch in parallel, and for dividing a part of current through the microswitch when the microswitch is switched on.

According to the present invention, a microwave oven is capable of preventing overcurrent of a microswitch by using a relay, and so on. A microwave oven can be heating/cooking food safely according to being prevented from a holding of the previous status of contacts in a microswitch by preventing overcurrent of a microswitch for controlling a DC power source.

BRIEF DESCRIPTION OF THE DRAWINGS

The above objective and other advantages of the present invention will become more apparent by being described in detail in a preferred embodiment thereof with reference to the attached drawings, in which.

BEST MODE FOR CARRYING OUT THE INVENTION

Figure 1:
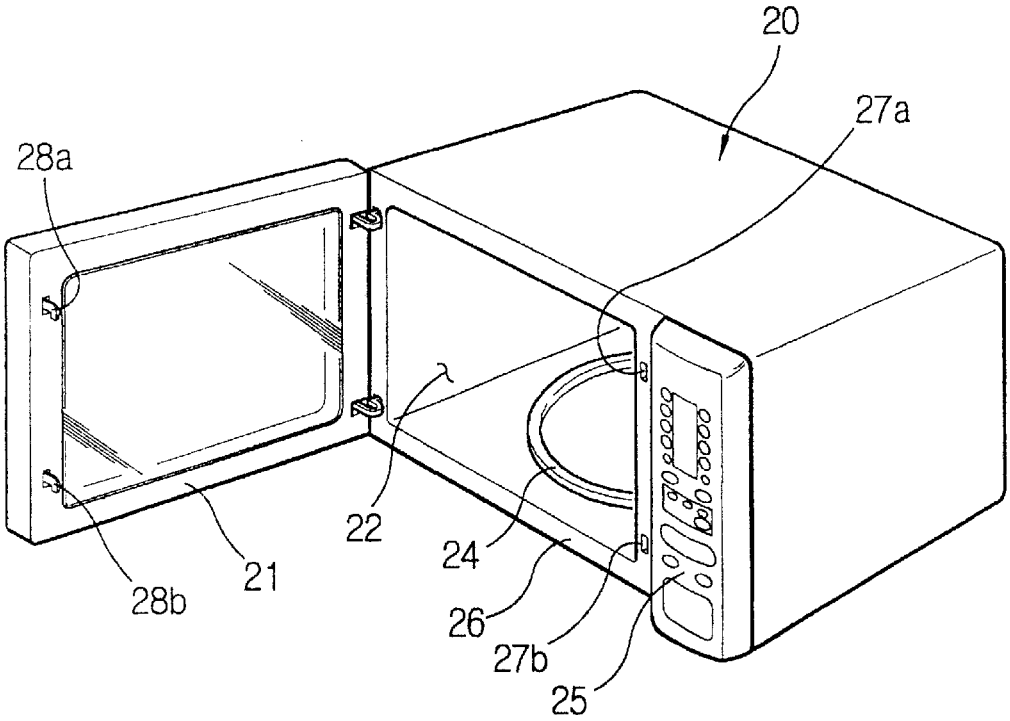
FIG. 1 is a cutaway view of a conventional microwave oven.
Figure 3A:
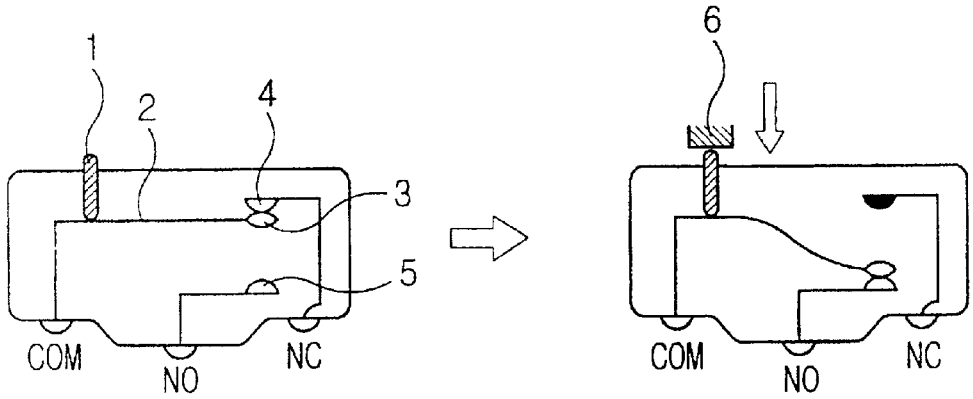
FIGS. 3*a* and 3*b* are a schematic diagram and symbols of the microswitch, respectively.
Figure 3B:
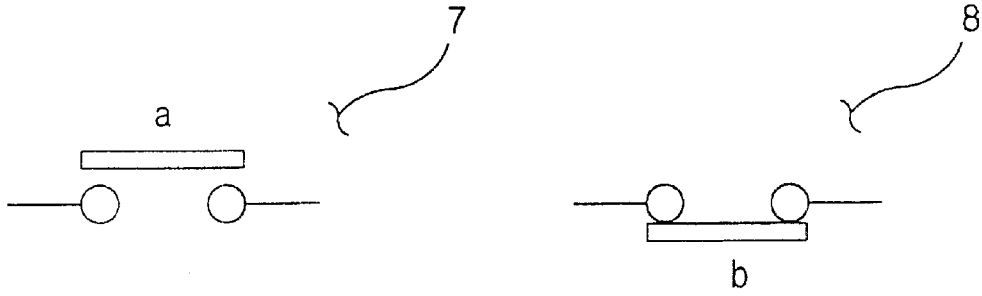
Figure 4:
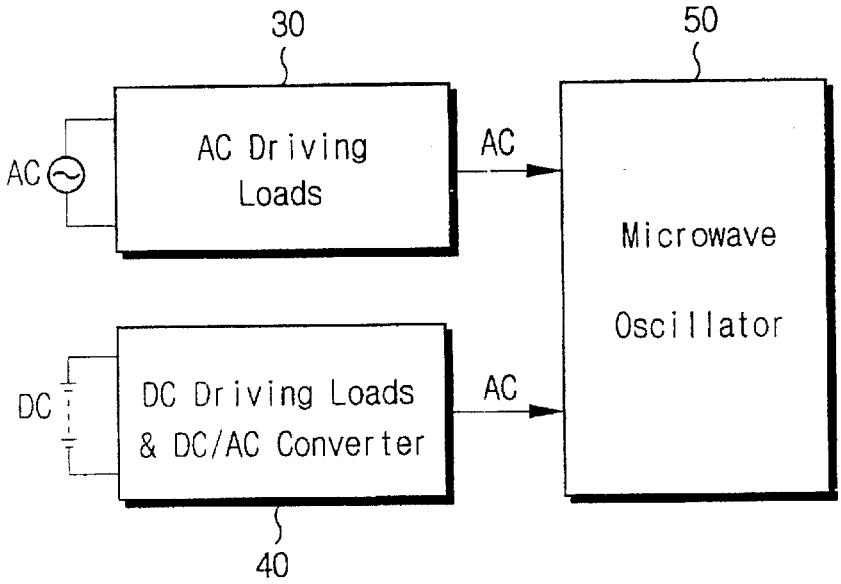
FIG. 4 is a block diagram of an AC/DC type microwave oven developed herein.

The present invention will become more apparent by describing in detail in a preferred embodiment thereof with reference to the attached drawings. If the parts of the present invention are the same as a conventional microwave oven as shown on FIGS. 1 and 3, the illustration can be abbreviated, and can be cited using the same reference numerals.

Figure 5:
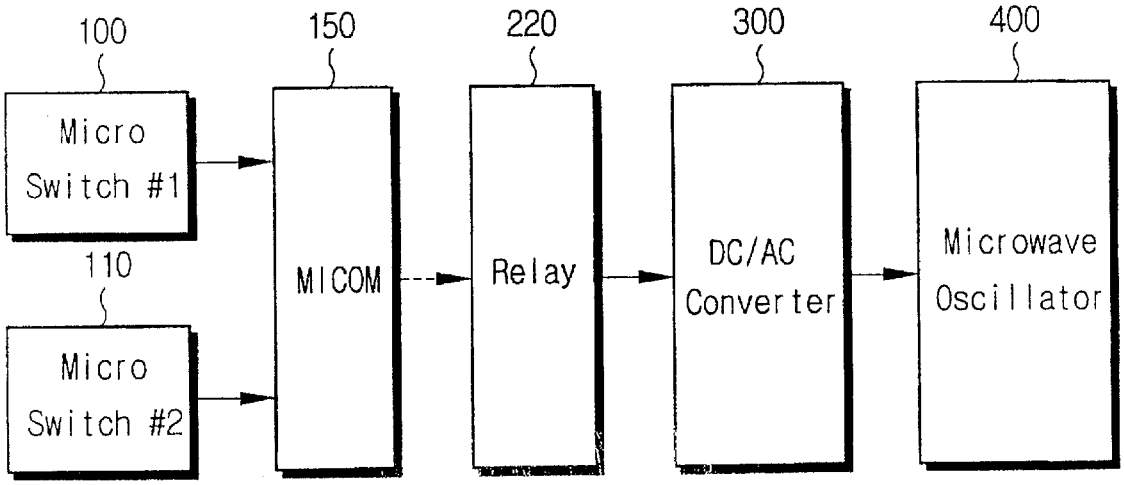
FIG. 5 is a block diagram of a microwave oven capable of preventing overcurrent of a microswitch for controlling a DC power source according to the first embodiment of the present invention.

FIG. 5 is a block diagram of a microwave oven capable of preventing overcurrent of a microswitch for controlling a DC power source according to the first embodiment of the present invention. In a microwave oven having a case forming a cooking chamber, a door for opening/closing the chamber, a high voltage transformer for generating a high voltage, and a magnetron for generating microwaves driven by the high voltage being outputted from the high voltage transformer, this microwave oven according to the first embodiment comprising: microswitches 100, 110 for detecting the opening/closing of the door; microcomputer 150 for controlling being outputted a driving signal corresponding to the detected result; and a relay 220 for opening/closing for controlling a power source supplied to the high voltage transformer according to receiving the driving signal; a DC/AC converter 300 for converting direct current supplied by a DC input power source into alternating current, and for supplying to the high voltage transformer; and a microwave oscillator 400 being driven by an output voltage of the high voltage transformer, and for generating microwaves. The relay 220 is an electrical relay which is opening/closing a supply of input power by opening/closing contacts according to the driving signal, and opens/closes a supply of large amounts of current from 50A to 70A.

Figure 8:
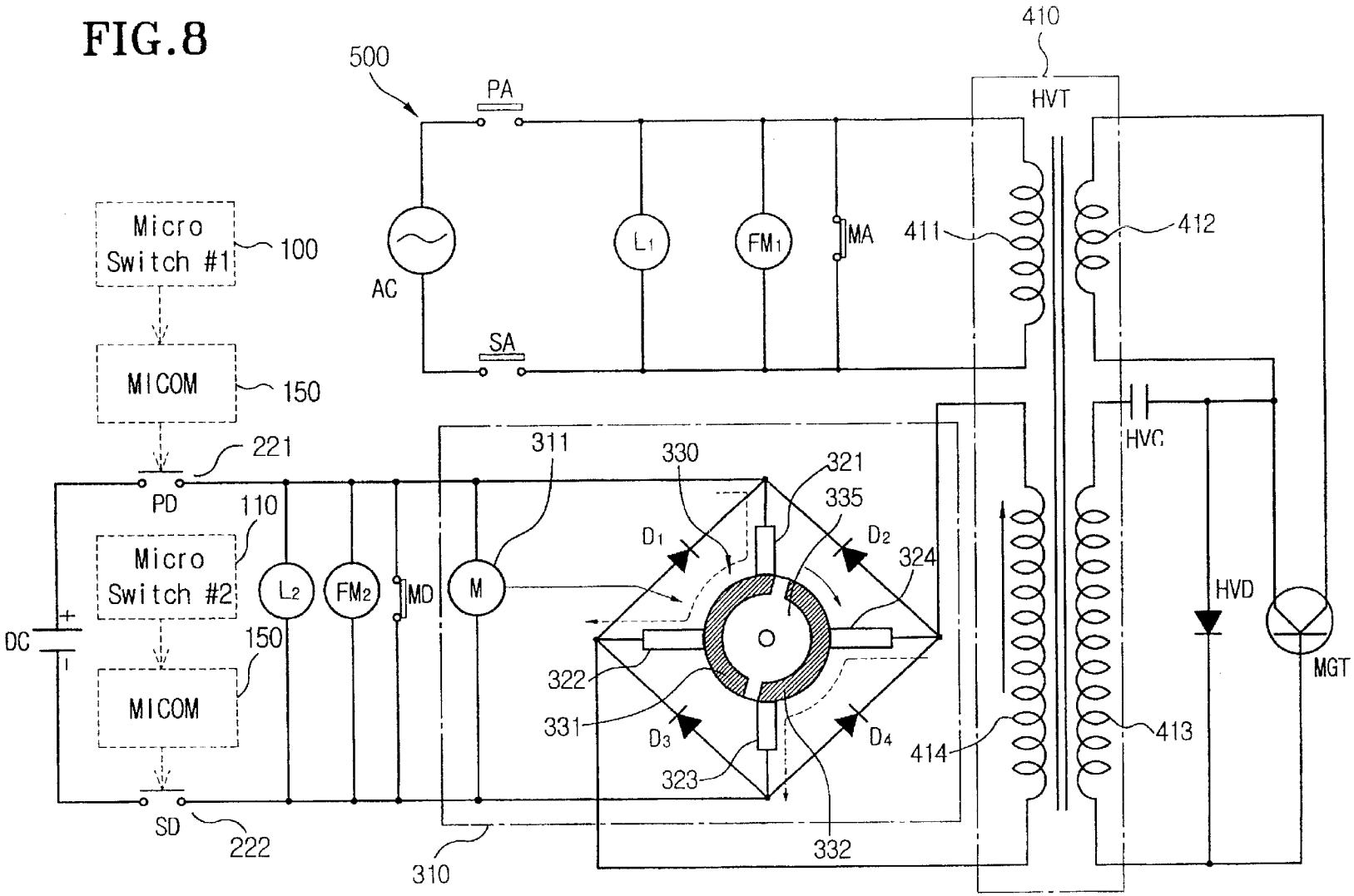
FIG. 8 is a schematic diagram of a microwave oven capable of preventing overcurrent of a microswitch for controlling a DC power source according to the first embodiment of the present invention.

FIG. 8 is a schematic diagram of a microwave oven capable of preventing overcurrent of a microswitch for controlling a DC power source according to the first embodiment of the present invention. This microwave oven according to the first embodiment comprises an AC circuit part 500, a DC circuit part 600, and a microwave oscillating part 400. The AC circuit part 500 supplies a high voltage transformer 410 with alternating current by an AC input power source, and the DC circuit part 600 supplies to the high voltage transformer 410 which converts alternating current after converting direct current supplied by a DC input power source into alternating current, and the microwave oscillating part 400 generates microwaves by means of the output voltage of the high voltage transformer 410. The DC circuit part 600 uses relays 221, 222 for opening/closing a DC input power source. The opening/closing of the door is detected by microswitches 100, 110, microcomputer produces the driving signal to the relays 221, 222 corresponding to the detected result, so the relays 221, 222 can open/close the DC input power source.

The microwave oven contains microswitches MS1, MS2, MS3 for controlling operations of each first switches PA, PD, each second switches SA, SD, and each monitor switches MA, MD. Substantially, the first microswitch MS1 operates along with the first switches PA, PD, the second microswitch MS2 operates along with the second switches SA, SD, and the third microswitch MS3 operates along with the monitor switches MA, MD, respectively.

The high voltage transformer 410 contains many coils 411, 412, 413, 414, and is driven by the AC circuit part 500 or the DC circuit part 600 to generate a high voltage of about 2,000V.

The AC circuit part 500 contains the first lamp L1, the first fan motor FM1, and the first and second switches PA, SA and the monitor switch MA for controlling an AC power.

If the first and second switches PA, SA are switched on and the monitor switch MA is switched off, the first lamp L1 and the first fan motor FM1 are driven, and the AC input power source supplies alternating current to the high voltage transformer 410 simultaneously. Then, the high voltage transformer 410 generates a high voltage, and a magnetron MGT generates microwaves by means of the high voltage.

The DC circuit part 600 contains the second lamp L2, the second fan motor FM2, a DC/AC converter 300 for converting direct current supplied by DC input power source into alternating current, and the relays 221, 222 along with a monitor switch MD for controlling a DC power.

The DC/AC converter 300 contains a commutator 330, a commutator motor M for rotating the commutator 330, and two pairs of brushes 321, 322, 323, 324 being contacted to the outer circle of the commutator 330. Two pairs of brushes 321, 322, 323, 324 consist of one of input brushes 321, 323 being connected to direct current, and one of output brushes 322, 324 being connected to the high voltage transformer 410. The pair of input brushes 321, 323 is contacted to the outer circle of the commutator 330, and supplies direct current to the commutator 330. The pair of output brushes 322, 324 is contacted to the outer circle of the commutator 330 and converts direct current supplied by the input brushes 321, 323 into alternating current, when the commutator 330 is rotated.

Figure 2:
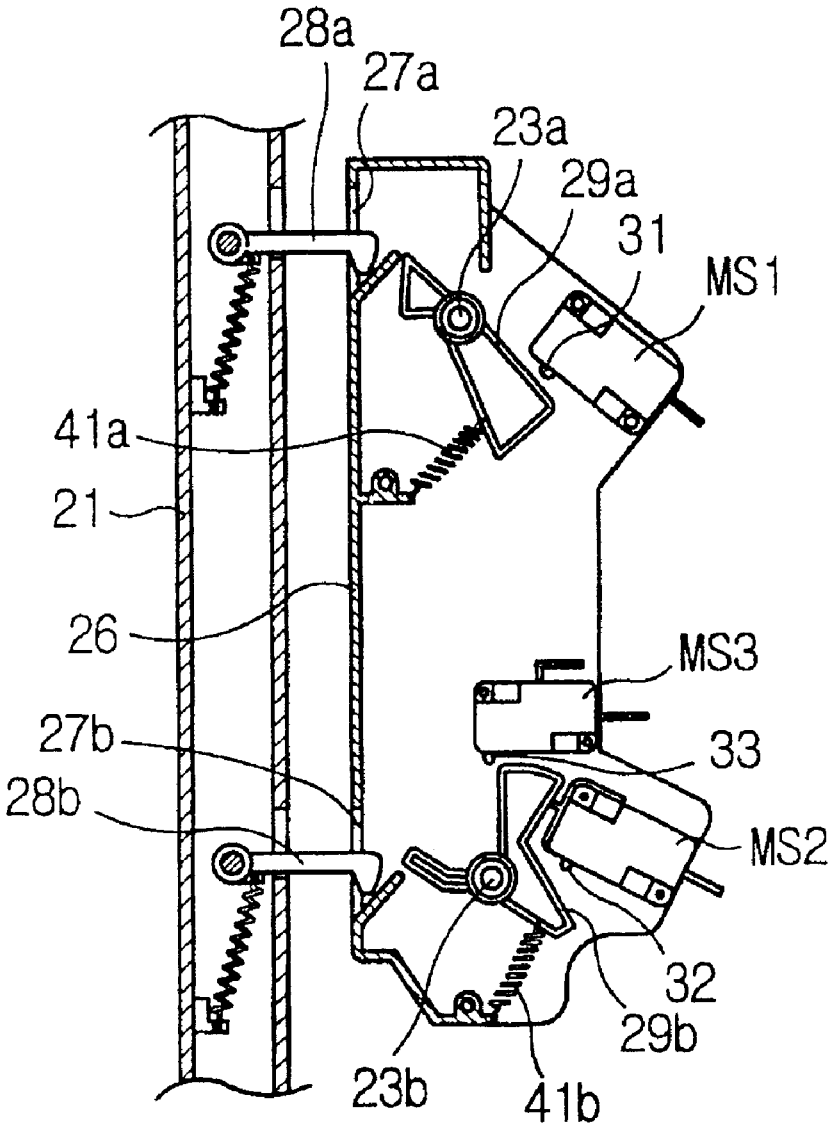
FIG. 2 is a partial cutaway view of FIG. 1 for explaining a microswitch and the operation of the opening/closing of the conventional microwave oven.

As shown in FIG. 2, microswitches MS1, MS2, MS3 are installed at the back side of the front plate 26 of the case 20. The microswitches MS1, MS2, MS3 have each operating button 31, 32, 33, respectively. At the back side of the front plate 26 is installed a pair of movable members 29*a*, 29*b* to adjoin the catch openings 27*a*, 27*b*. Then, the movable members 29*a*, 29*b* are fixed for pivoting by each pin 23*a*, 23*b*, and are fixed elastically by each spring 41*a*, 41*b*.

If the door 21 is pushed close, the microswitches MS1, MS2, MS3 are operated by the latch hooks 28*a*, 28*b* which are inserted in the catch openings 27*a*, 27*b*. That is, when the movable members 29*a*, 29*b* are pushed by each latch hook 28*a*, 28*b*, the movable members 29*a*, 29*b* are rotated against the elasticity of the springs 41*a*, 41*b*. Therefore, the operating button 31 is pushed by the upper movable member 29*a*, and the operating buttons 32, 33 are pushed by the lower movable member 29*b*, respectively.

Therefore, when the AC power source supplies alternating current to the AC circuit part 500, and the DC power source supplies direct current to the DC circuit part 600, respectively, the AC/DC type microwave oven is operated.

In the microwave oven according to the first embodiment of the present invention, the microswitches 100, 110 detect the opening/closing of the door, microcomputer 150 produces the driving signals to the relays 221, 222 corresponding to the detected results, and the relays 221, 222 are to open/close the supply of the DC input power source. When the microwave oven is supplied with large amounts of current from 50A to 70A, the microwave oven does not use the microswitches 100, 110 directly to control the supply of the DC input power source, but use the relays 221, 222 capable of not generating the holding of the previous status of contacts, instead of the microswitches 100, 110. Therefore, the microwave can be used more safely.

Figure 6:
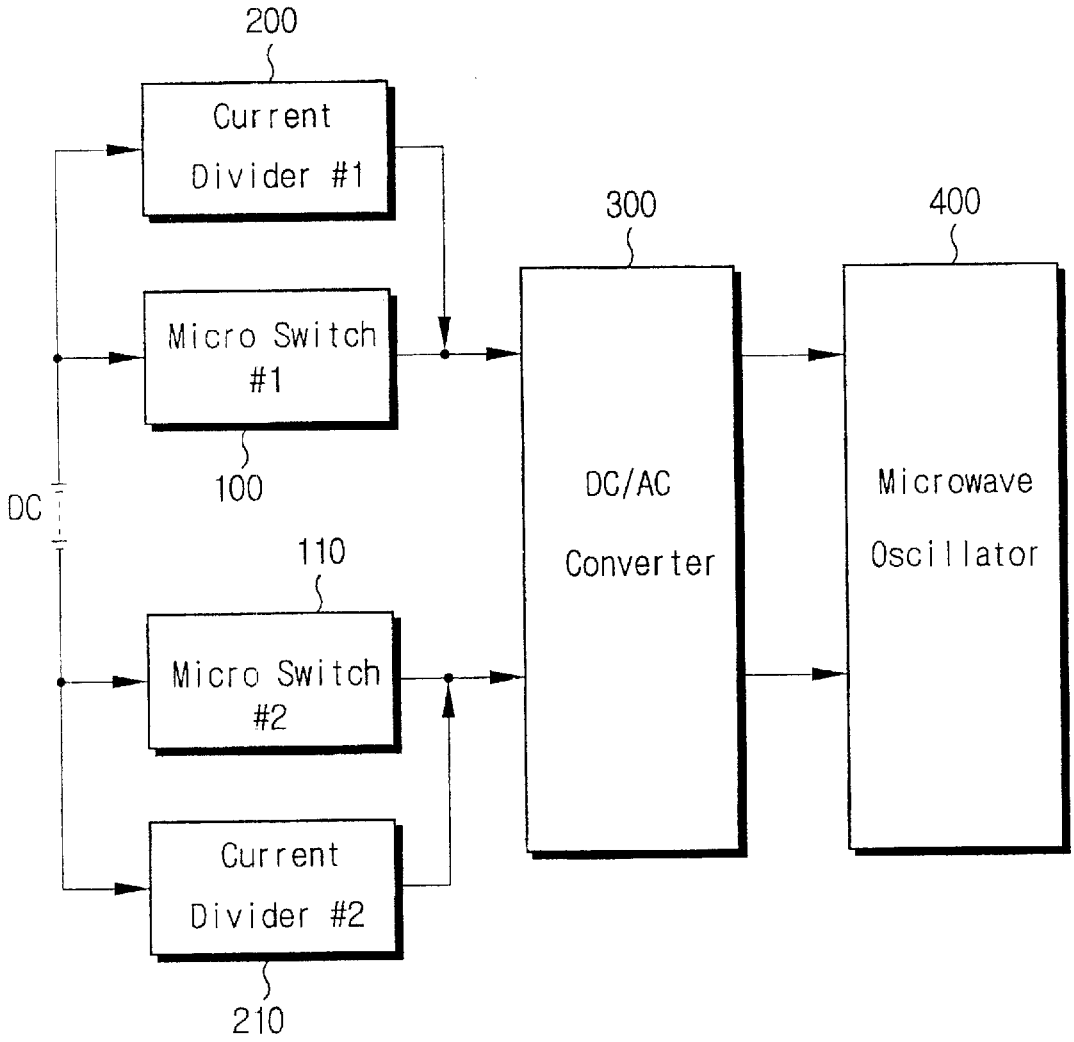
FIG. 6 is a block diagram of a microwave oven capable of preventing overcurrent of a microswitch for controlling a DC power source according to the second embodiment of the present invention.

FIG. 6 is a block diagram of a microwave oven capable of preventing overcurrent of a microswitch for controlling a DC power source according to the second embodiment of the present invention. This microwave oven comprising: a DC/AC converter 300 for converting direct current supplied by a DC input power source into alternating current, and for supplying the converted alternating current to the high voltage transformer; microswitches 100, 110 for openinig/closing a connection between the DC input power source and the DC/AC converter 300; current dividers 200, 210 being connected to the microswitches 100, 110 in parallel, and for dividing a part of current supplied by the microswitches 100, 110 when the microswitches 100, 110 are switched on; and a microwave oscillator 400 for being driven by an output voltage of the high voltage transformer, and for generating microwaves. The microswitches 100, 110 are operated by the door for opening/closing the cooking chamber. The current dividers 200, 210 include relays being connected to the microswitches 100, 110 in parallel, and include resistors being connected to the microswitches 100, 110 and/or the relays 200, 210 in series. The resistors can regulate rates of current through the microswitches 100, 110 and the relays 200, 210. When overcurrent is supplied to the microswitches 100, 110, the microwave oven is capable of being prevented from the holding of the previous status of contacts accordingly as a part of overcurrent is consumed by operations of the relays 200, 210.

Figure 7A:
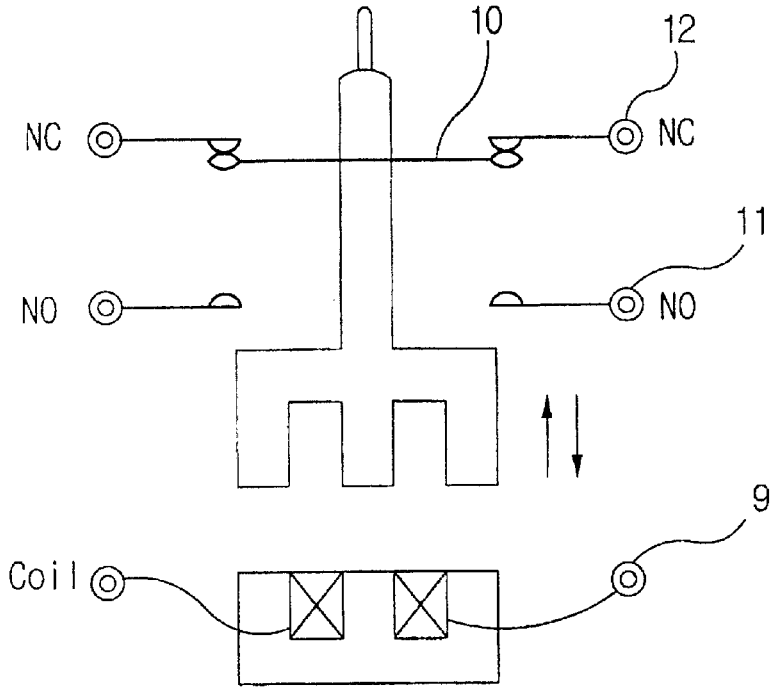
FIGS. 7*a* and 7*b* are a block diagram and symbols of relays of FIGS. 5 and 6, respectively.
Figure 7B:
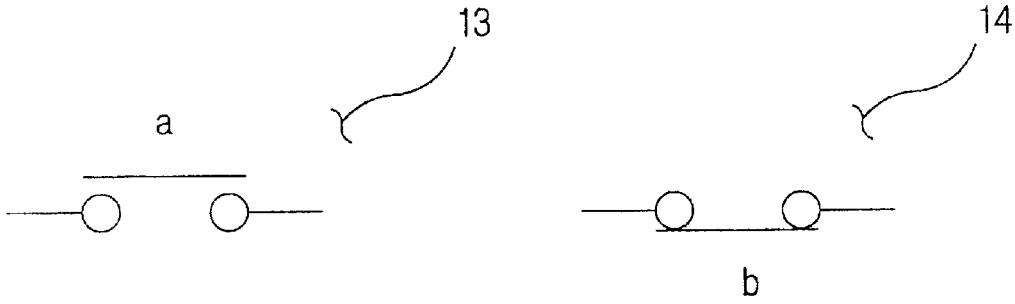

FIGS. 7*a* and 7*b* are a block diagram and symbols of relays of FIGS. 5 and 6, respectively. The relay called an electromagnetic relay has a hinge-type relay and a plunger-type relay, etc. Because the characteristic of isolation of the plunger-type relay is excellent, and the capability of contact is large, the plunger-type relay is used as an electromagnetic contactor, an electromagnetic switch, and an auxiliary relay of power type, etc. In the plunger type relay, a moving-iron is moving linearly in an electromagnetic coil according to being excited or being degaussed by the electromagnetic coil, and a mechanism of contact being connected to the moving-iron is opened/closed by using the movement of the moving-iron. The exciting represents flowing current, while the degaussing represents not flowing current. The reference numeral 9 is a coil, the reference numeral 10 is an independent contact, the reference numeral 11 is a normally open terminal, and the reference numeral 12 is a normally closed terminal. When current flows through the coil 9, the coil part becomes an electromagnet to pull the independent contact 10, and the independent contact 10 is connected to the normally open terminal 11 instead of the normally closed terminal 12. Then, current is used for magnetizing the coil 9. As shown in FIG. 7*b*, contact a 13 means the status of connecting the independent contact 10 to the normally open terminal 11 when current flows through the coil 9. Contact b 13 means the status of connecting the independent contact 10 to the normally closed terminal 12 when current is not flowing through the coil 9.

Figure 9:
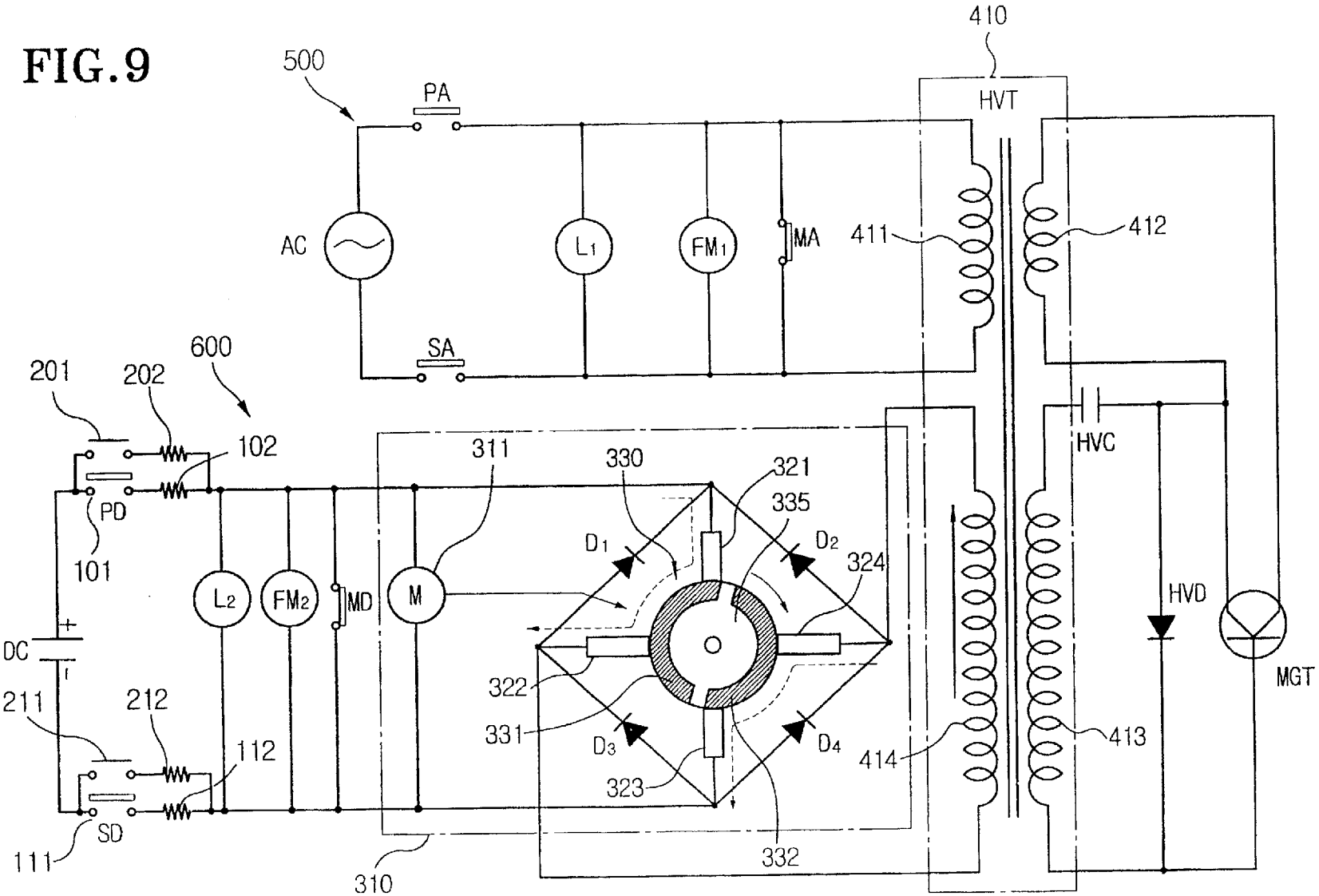
FIG. 9 is a schematic diagram of a microwave oven capable of preventing overcurrent of a microswitch for controlling a DC power source according to the second embodiment of the present invention.

FIG. 9 is a schematic diagram of a microwave oven capable of preventing overcurrent of a microswitch for controlling a DC power source according to die second embodiment of the present invention. This microwave oven according to the second embodiment comprises an AC circuit part 500, a DC circuit part 600, and a microwave oscillating part 400. The AC circuit part 500 supplies a high voltage transformer 410 with alternating current by an AC input power source, and the DC circuit part 600 supplies to the high voltage transformer 410 which converts alternating current after converting direct current supplied by a DC input power source into alternating current, and the microwave oscillating part 400 generates microwaves by means of the outputting voltage of the high voltage transformer 410. The operation of the AC circuit part 500 and the microwave oscillating part 400 are the same as above-described in the first embodiment. The opening/closing of the DC input power source in the DC circuit part 600 is accomplished by means of the microswitches 100, 110. Therefore, this microwave oven can prevent the holding of the previous status of large amounts of current in the microswitches 100, 110 by using differentiated current dividers 201, 211. The microwave oven according to the second embodiment contains the first relay 201, and the second relay 211 being connected to the microswitches 100, 110 in parallel. The relays 201, 211 are turned on when the microswitches 100, 110 are turned on, respectively. Accordingly, at least a part of current through the microswitches 100, 110 is flowing through the relays 201, 211.

Since direct current being supplied by the DC input power source is divided by the microswitches 100, 110 and the relays 201, 211, the amounts of current through the microswitches 100, 110 can be reduced. Accordingly, the holding of the previous status of contacts in the microswitches 100, 110 is capable of being prevented, and the operations of the microswitches 100, 110 are accomplished safely.

The second embodiment according to the present invention, however, uses the relays 201, 211 which are the means for dividing a part of current through the microswitches 100, 110, and uses a device of a non-contact switch, etc.

This microwave oven can heat/cook food by using both the DC input power source and the AC input power source. Then, this microwave oven contains a differentiated selecting switch (not shown) to operate selectively the DC circuit part 600 or the AC circuit 500.

Meanwhile, each resistor 102, 112, 202, 212 is connected to the relays 201, 211 and the switches PD, SD in series. This resistors 102, 112, 202, 212 are used for current-limiting. As each resistor 102, 112, 202, 212 is controlled adequately, the rates of current through the microswitches 100, 110 and the relays 201, 211 are capable of being regulated. When the rates of current are regulated by using the resistors 102, 112, 202, 212, the microswitches 100, 110 are capable of being prevented easily from the holding of the previous status of contacts.

In the second embodiment, however, according to present invention, this microwave oven adapts the relays 201, 211 for preserving the first and second microswitches MS1, MS2, and adapts an additional relay for preserving the third microswitch MS3 as shown in FIG. 2.

As above-described, this microwave oven according to the present invention is capable of preventing from the holding of the previous status of contacts in the microswitches by being prevented the overcurrent of the microswitches. Accordingly, this microwave oven is capable of being prevented from faulty operations of the microswitches, and the heating/cooking of the microwave oven is accomplished safely.

While the present invention has been particularly shown and described with reference to the preferred embodiment thereof, it will be understood by those skilled in the art that various changes in form and details may be affected therein without departing from the spirit and scope of the invention as defined by the appended claims.

What is claimed is:

1. A microwave oven having a case forming a cooking chamber, a door for opening/closing said chamber, a high voltage transformer for generating a high voltage, and a magnetron for generating microwaves driven by said high voltage being outputted from said high voltage transformer, the microwave oven comprising:

means for detecting opening/closing of said chamber;

means for controlling for outputting a driving signal corresponding to said detected opening/closing of said chamber; and means for opening/closing for controlling a power source supplied to said high voltage transformer according to reception of said driving signal.

2. The microwave oven as claimed in claim 1, wherein said means for detecting is a microswitch which is a detector for detecting said opening/closing of said cooking chamber.

3. The microwave oven as claimed in claim 1, wherein said means for opening/closing is an electromagnetic relay for controlling an opening/closing of an input power source to open/close a contact according to said driving signal.

4. The microwave oven as claimed in claim 3, wherein said electromagnetic relay is a relay for controlling a supply of large amounts of current from 50A to 70A.

5. In a microwave oven having a case forming a cooking chamber, a door for opening/closing said chamber, a high voltage transformer for generating a high voltage, and a magnetron for generating microwaves driven by said high voltage being outputted from said high voltage transformer, an interlocking device of a microwave oven comprising:

microswitches for detecting opening/closing of said chamber;

means for controlling for outputting a driving signal corresponding to said detected opening/closing of said chamber; and a relay for opening/closing for controlling a power supplied to said high voltage transformer according to reception of said driving signal.

6. The interlocking device of the microwave oven as claimed in claim 5, wherein said electromagnetic relay is a relay for controlling a supply of large amounts of current from 50A to 70A.

7. A microwave oven using microwaves, comprising:

a direct current (DC) circuit part for converting direct current supplied by a DC input power source into alternating current, and for supplying said converted alternating current;

opening/closing means for connecting between said DC input power source and said DC circuit part;

current dividing means connected to said opening/closing means for dividing a part of current supplied by said opening/closing means when said opening/closing means is switched on; and microwave oscillating means driven by an output voltage of a high voltage transformer for generating microwaves.

8. The microwave oven as claimed in claim 7, wherein said opening/closing means is a contact type microswitch operated by opening/closing of said door.

9. The microwave oven as claimed in claim 7, wherein said current dividing means is a relay connected in parallel with said opening/closing means.

10. The microwave oven as claimed in claim 9, further comprising resistors connected in series with said opening/closing means and said relay current dividing means respectively, for regulating each rate of current through said opening/closing means and said relay, respectively.

11. The microwave oven as claimed in claim 7, wherein said current dividing means is a non-contact switch connected in parallel with said opening/closing means.

12. A device for preventing overcurrent of a microswitch, comprising:

a microswitch for opening/closing a connection between a direct current (DC) input power source and a DC circuit part supplied with direct current; and current dividing means connected in parallel with said microswitch for dividing a part of current through said microswitch when said microswitch is switched on.

13. The device for preventing overcurrent of a microswitch as claimed in claim 12, wherein said current dividing means is a relay connected in parallel with said microswitch.

14. The device for preventing overcurrent of a microswitch as claimed in claim 13, further comprising resistors connected in series with said microswitch and said relay current dividing means, respectively, for regulating each rate of current through said microswitch and said relay, respectively.

* * * * *